United States Patent [19]

Pielemeier et al.

[11] Patent Number: 4,719,769

[45] Date of Patent: Jan. 19, 1988

[54] ONE WAY CLUTCH FOR DUAL ACTION AGITATOR

[75] Inventors: John W. Pielemeier, St. Joseph; Dale E. Mueller, Benton Township, Berrien County, both of Mich.

[73] Assignee: Whirlpool Corporation, Benton Harbor, Mich.

[21] Appl. No.: 848,935

[22] Filed: Apr. 7, 1986

[51] Int. Cl.[4] ..... D06F 17/08

[52] U.S. Cl. ..... 68/133; 74/126; 192/35; 192/46

[58] Field of Search ..... 68/131–134; 74/126; 192/46, 35

[56] References Cited

U.S. PATENT DOCUMENTS

| | | | |
|---|---|---|---|
| Re. 12,030 | 9/1902 | Houghtaling | 192/46 |
| 70,059 | 10/1867 | Wilber | 192/46 |
| 628,249 | 7/1899 | Kane | 192/46 |
| 1,473,564 | 11/1923 | Klepper et al. | 192/46 X |
| 1,960,004 | 5/1934 | Franz | 192/46 X |
| 1,969,368 | 8/1934 | Hansen | 74/126 X |
| 2,129,566 | 9/1938 | Curtis | 74/126 |
| 3,667,307 | 6/1972 | Kelch | 74/126 |
| 3,678,714 | 7/1972 | Krolzick | 68/131 |
| 3,987,508 | 10/1976 | Platt | 8/159 |
| 3,987,651 | 10/1976 | Platt | 68/133 |
| 3,987,652 | 10/1976 | Ruble | 68/134 |
| 4,155,228 | 5/1979 | Burgener, Jr. et al. | 68/133 |
| 4,164,130 | 8/1979 | Hammer | 68/133 |
| 4,452,054 | 6/1984 | Hafstrom | 68/133 |
| 4,520,638 | 6/1985 | Brenner | 68/133 |

*Primary Examiner*—Philip R. Coe

*Attorney, Agent, or Firm*—Hill, Van Santen, Steadman & Simpson

[57] ABSTRACT

A dual action agitator for use in a washing machine utilizes a one-way dog clutch having a plurality of dogs made of elastomeric material and pivotally mounted in a cam. The dogs pivot outward to engage an inner surface of an upper agitator barrel to drive the agitator barrel in a first direction during a first oscillatory stroke of a lower agitator skirt, and the dogs pivot away from the inner surface as the lower agitator skirt oscillates in a second opposite direction resulting in unidirectional movement of the agitator barrel to impart additional mechanical motion to a wash load and promote roll-over.

17 Claims, 7 Drawing Figures

ONE WAY CLUTCH FOR DUAL ACTION AGITATOR

BACKGROUND OF THE INVENTION

1. Field of the Invention

The present invention relates generally to a clutch mechanism in the driving train of a washing machine agitator.

2. Description of the Prior Art

It is recognized that dual action agitators in washing machines provide improved washing action and facilitate uniform cleaning of larger loads. Such dual action agitators generally include a lower radially vaned agitator portion that moves in an oscillatory fashion and an upper agitator portion that moves in a separate path from the lower portion. The motion of the upper portion provides rollover of the clothes load for more uniform cleaning during a washing cycle.

A method and apparatus for dual action agitation in a washing machine are disclosed in U.S. Pat. Nos. 3,987,508 and 3,987,651 in which an auger-like vane driven by a one way clutch provides rollover of clothes toward an oscillating main agitator element. A clutch for use in such dual action agitator is disclosed in U.S. Pat. No. 4,164,130 that includes a pair of clutch shoes which are thrust outward by a cam surface to an engagement surface of an auger on a first oscillation motion and which are engaged at a capture surface and drawn inward on a reverse oscillation motion. The specification reveals that should the clutch parts become wet they may stick and cause the clutch not to work.

A ratchet-type clutch for dual action agitators is disclosed in U.S. Pat. No. 4,155,228 that includes upwardly and downwardly directed teeth for mutual engagement, each tooth having a slip surface and a drive surface. A one way clutch is also disclosed in U.S. Pat. No. 3,987,652 in which a plurality of pawls engage a series of teeth on a ratchet ring.

Dual action agitators are also known in which vertical motion is imparted to an upper agitator barrel. For instance, in U.S. Pat. No. 3,678,714 a cam follower roller moving over high and low points on a cam surface drives a secondary agitator vertically. In U.S. Pat. No. 4,520,638, a pin riding in a recessed parallelogram provides vertical movement, while in U.S. Pat. No. 4,452,054, driving lugs engage spiral drive surfaces for vertical reciprocating motion of an upper portion of an agitator.

SUMMARY OF THE INVENTION

The present invention provides a quiet unidirectional drive for an upper agitator barrel with a minimum of lost motion, and is particularly useful in washers that utilize a short agitator stroke. The invention is embodied in a one-way dog clutch having a plurality of dogs pivotally mounted in a cam to engage an inner face of an upper barrel in a dual-action agitator to drive the barrel during a first portion of the agitator stroke.

The dogs pivot inwardly and disengage the barrel surface enabling the barrel to remain stationery during a second, opposite portion of the agitator stroke. The dogs are preferably mounted to engage diametrically opposed portions of the barrel surface for improved gripping power and positive unidirectional drive. By pivoting away from the inner barrel surface during a non-driving portion of the agitator stroke, ratcheting sounds are avoided during operation of the present clutch. Furthermore, the dogs are formed of a resilient tough material, such as a durable rubber, to insure quiet clutch operation. As the agitator stroke changes from the non-driving direction to the driving direction, the dogs quickly engage the inner barrel surface for a minimum of lost motion on each agitator stroke which provides improved washing action by imparting additional mechanical energy to the wash load.

In a preferred embodiment, the cam in which the dogs are mounted supports the dogs at a critical angle of contact with the inner barrel surface to prevent clutch slippage and over torquing. A support fin is included on the cam for each dog to prevent clutch failure. The inner barrel surface is preferably toothed and a cooperating notch is formed on a contact surface of each dog to reduce the likelihood of slippage. The one-way clutch for a dual-action washing machine agitator of the present invention is formed of relatively inexpensive materials, is simple to assemble and inexpensive to manufacture.

DESCRIPTION OF THE PREFERRED EMBODIMENTS

Figure 1:
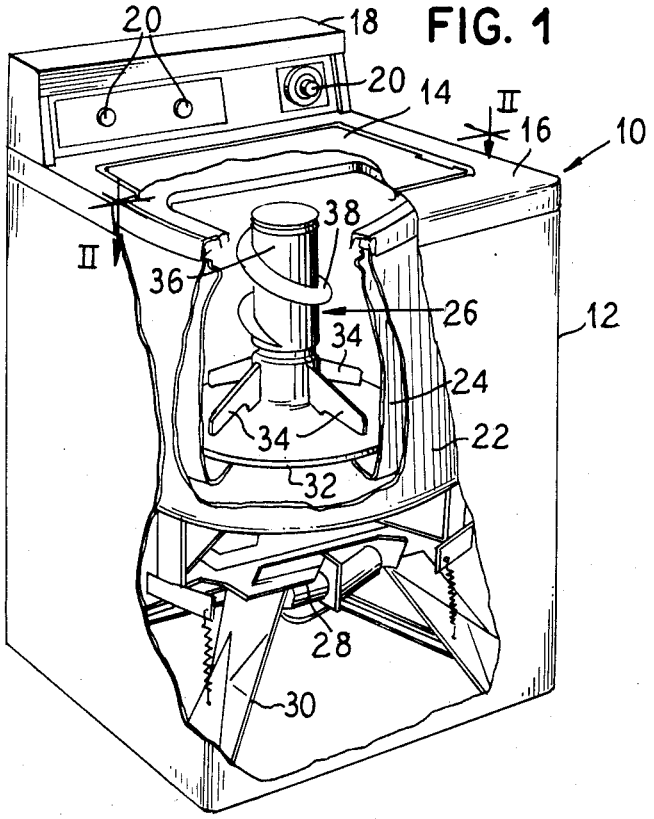
FIG. 1 is a perspective view of a washing machine, partially cut away to reveal a dual-action agitator utilizing a one-way clutch according to the principles of the present invention.

In FIG. 1 there is shown an automatic washing machine generally at 10 including a cabinet 12 having an openable door 14 in a top panel 16 thereof and a control console 18 along a back portion thereof including a plurality of presettable controls 20 for automatically controlling selected laundering cycles having washing, rinsing and drying periods in a program. A washing tub 22 is mounted within the cabinet 12 and includes an interior perforate basket 24 forming a treatment zone and a dual action agitator 26 driven by a motor and transmission 28, all of which is mounted on a support frame 30. The agitator 26 includes a lower oscillating skirt 32 with radial fins 34 and an upper unidirectional barrel 36 having an auger-like vane 38 helically arranged at an exterior surface thereof.

Figure 2:
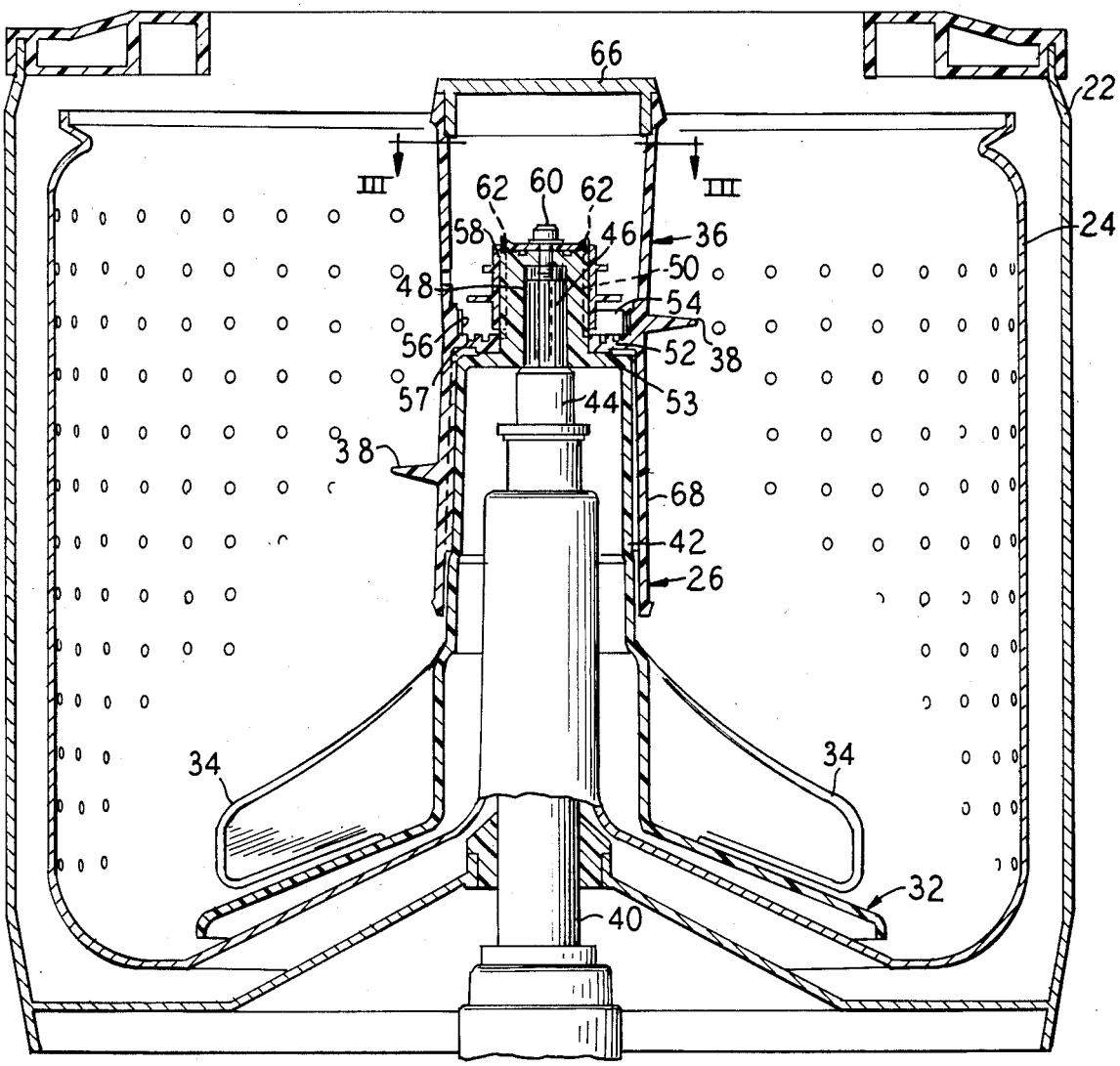
FIG. 2 is a cross-section through the tub, basket and agitator of the washing machine shown in FIG. 1 along lines II—II.

In FIG. 2, a drive shaft 40 extends upward into the center of the wash tub 22 and the perforate basket 24 to support and drive the agitator 26. The agitator skirt 32 has an inner cylinder portion 42 over which the upper agitator barrel 36 is mounted. An upper end 44 of the drive shaft 40 includes a splined connector 46 over which is mounted a splined opening 48 that is within a cam mounting cylinder 50 at the top of the agitator skirt 32. The upper agitator barrel 36 is fitted over the cylinder portion 42 and is supported by an annular mounting ring 52 resting on a bearing surface 53. The agitator barrel 36, thus, is rotatable independently of the agitator skirt 32.

A plurality of dogs 54 are provided within the upper agitator barrel 36 resting on the annular mounting ring 52 and are movable to engage an inner friction surface 56 of the upper agitator barrel 36. In a preferred embodiment, the mounting ring 52 is slotted at 57 to enable water to escape from beneath the dogs 54. The dogs 54 are held loosely by a cam 58 which is fitted over the cam mounting cylinder 50 of the lower agitator skirt 32. The cam 58 and lower agitator 32 are secured to the drive shaft 40 by a bolt 60 extending into the splined shaft end 46. The cam mounting cylinder 50 includes four external splines 62 (only two shown) extending radially outwardly therefrom which rotationally lock the cam 58 in place. The cam 58, thus, moves with the agitator skirt 32 while the agitator barrel 36 can move independently. The top of the agitator barrel 36 is enclosed by a cap 66.

Figure 3:
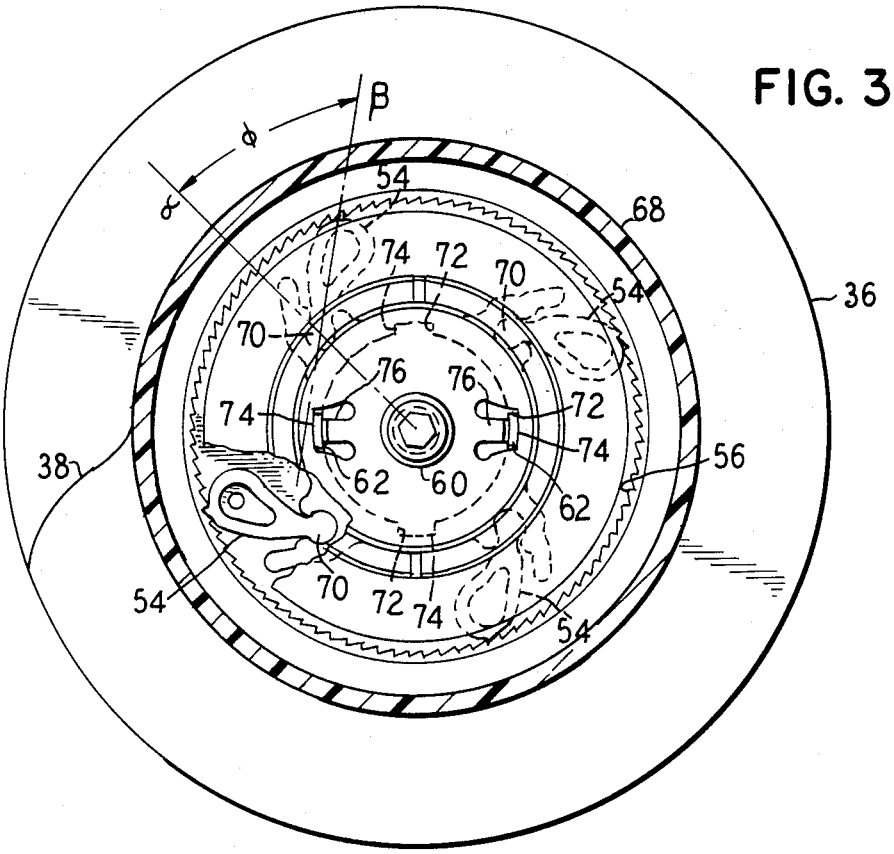
FIG. 3 is a cross-section through the upper agitator barrel in FIG. 2 along lines III—III to show the one-way clutch.

In FIG. 3, a preferred embodiment of the dog clutch mechanism of the present invention is shown in more detail, which includes four dogs 54 for engaging the toothed inner surface 56 of the upper agitator barrel 36. The dogs 54 are held loosely by the cam 58 so that they pivot into and out of contact with the inner surface 56 and so that they rest on the mounting ring 52. The dogs 54 engage the toothed inner surface 56 as the drive shaft 40 and lower agitator 32 rotate in a clockwise direction with respect to FIG. 3. However, when the drive shaft 40 and lower agitator 32 rotate in a counter-clockwise direction, the dogs 54 pivot inwardly out of contact with the toothed surface 56 to allow the upper agitator 36 to remain stationary. Frictional engagement between the dogs 54 and the annular mounting ring 52 cause the dogs 54 to pivot inwardly and outwardly during oscillatory movement of the agitator drive so that the upper agitator 36 is moved unidirectionally.

Each dog 54 is held at one end by the cam 58 for limited pivotal movement about a pivot shaft portion 70. The pivotal movement of each dog is defined by particular angular constraints for improved clutch performance. Namely, an engagement angle $\phi$ extending between a radial line $\alpha$ drawn through the center of the drive shaft 40 and the pivot point 70 of the dog 54 and a line $\beta$ extending through the dog pivot point 70 to the point of contact between the dog 54 and the toothed inner surface 56. If such engagement angle $\phi$ is too large, slippage of the clutch results, but, if the angle $\phi$ is too small, over torquing of the clutch is possible and dimensions of the elements become more critical. The engagement angle $\phi$ is preferably within a range of between 45° and 70°.

The cam 58 includes a plurality of key ways 72 which cooperatively engage ridges 74 on the cam mounting cylinder 50. In the embodiment shown, two opposed ones of the ridges 74 are below the projections 62 which extend upwardly beyond the cam mounting cylinder 50 and are engaged by gripping tabs 76 to lock the cam 58 in place.

Figure 4:
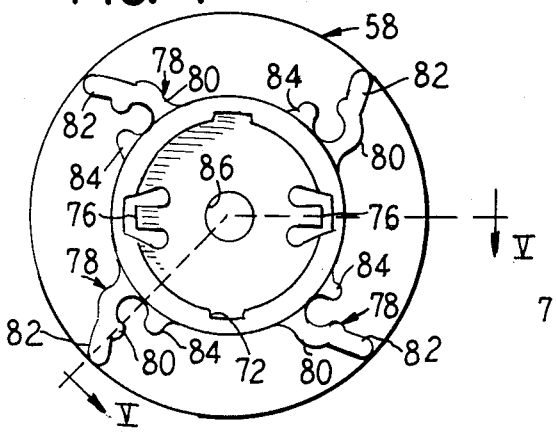
FIG. 4 is a bottom plan view of a cam portion of the one-way clutch.

In FIG. 4, the cam 58 is shown from the bottom including dog engaging portions 78 formed of a curved retaining rib 80 having thereon a support fin 82 and having spaced therefrom a stop 84. The pivot shaft portions 70 of the dogs 54 fit loosely into the shaped opening formed by the curved retaining rib 80 and the stop 84. The support fins 82 prevents the dogs 54 from being over-torqued and bending backward under heavy load conditions. The stop 84 restricts excessive inward pivotal movement of the dogs 54 and, thus, reduces lost motion during clutch operation.

Figure 5:
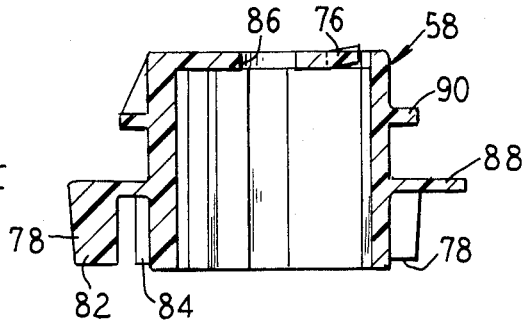
FIG. 5 is a cross-section of the cam shown in FIG. 4 along lines V—V.

Referring to FIG. 5, the cam 58 may be of generally cup-shaped configuration to fit over the cam mounting cylinder 50. An opening 86 is formed in the top center portion thereof through which the bolt 60 is inserted. A first radially projecting flange 88 provides support for the dog engaging portions 78, and restricts upward movement of the dogs 54. A second flange 90 is spaced from the first flange 88 and provides additional support for the cam 58.

Figure 6:
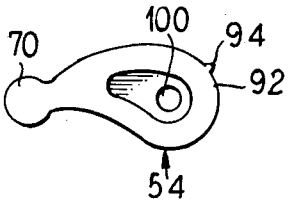
FIG. 6 is an enlarged plan view of an individual dog of the one-way clutch.
Figure 7:
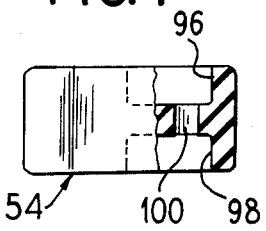
FIG. 7 is an elevational view, partially in cross-section, of the dog shown in FIG. 6.

In FIG. 6 is shown an individual dog 54 including the pivot shaft portion 70 about which the dog 54 pivots in the cam 58. On a contact surface 92 is provided a notch or tooth 94 for engagement with the inner barrel surface 56. The notch 94 insures positive engagement between the dog 54 and the toothed inner surface 56 during the drive portion of the agitator stroke. As can be seen in FIG. 7, a pair of oppositely formed shaped recesses 96 and 98 are provided in the dog 54 improved moldability and use less material. An opening 100 extends through the dog 54 through which air can escape to prevent bouyancy of the dog should a quantity of water accumulate around the clutch.

The present invention operates as follows: during a washing cycle, the motor and transmission 28 move the drive shaft 40 in rotational oscillations. The agitator skirt 32 likewise oscillates so that the fins 34 impart scrubbing action to the wash load, as well as direct the wash load peripherally outward for limited rollover of the load. Additional rollover is provided by the auger blade 38 on the barrel 36. Unidirectional movement of the barrel 36 drives portions of the wash load adjacent thereto downwardly to the oscillating fins 34; thus increasing the rollover rate of the wash load, particularly for heavy wash loads. The result is that the wash load is cleaned more uniformly and more efficiently.

The barrel 36 is driven unidirectionally in increments by the present dog clutch. During a first portion of each oscillation stroke, the dogs 54 engage the inner surface 56 so that the rotational movement of the cam 58 moves the barrel 36. Upon a reverse oscillation stroke, the dogs 54 pivot somewhat inwardly and out of contact with the inner barrel surface 56. Contact of the auger blade 38 with the wash load and the wash water impedes movement of the barrel 36 in the reverse direction, causing the barrel 36 to remain substantially stationary as the agitator skirt 32 traverses the return stroke. As another forward stroke is begun, the dogs 54 quickly pivot outwardly to again engage the inner surface 56 resulting in very little lost motion. Lost motion is defined for purposes of the present specification as that portion of the agitator stroke between the beginning of the forward oscillation movement of skirt 32 and the point at which the barrel 36 is engaged by the dogs 54 and begins to move.

Pivotal movement of the dogs 54 is caused primarily by the frictional engagement of the dogs 54 with the mounting ring 52 as the cam 58 moves relative to the barrel 36. Thus, the preferred dogs 54 are heavier than water so as to operate should the clutch become submerged. Moreover the slots 53 are formed in the mounting ring 52 so that any solid debris can collect in the slots and thus not interfer with the motion of the dogs 54. Since the dogs 54 are held loosely by the cam 58, only minimal friction is required for the dogs 54 to pivot.

The material from which the dogs 54 are formed is important in the function of the present device, for if the material is too hard, the dogs won't catch and bite on the toothed surface 56, and if the material is too soft the dogs will wear and may bend. An elastomeric material of 85 to 90 Durometer has been found to optimize performance. The elastomeric material also contributes to the quiet operation of the clutch since little noise is generated as the dogs 54 pivot into engagement with the surface 56.

Although the embodiment disclosed uses four dogs 54, it would be within the spirit of this invention to use a fewer or greater number of dogs. An even number of dogs at diametrically opposed positions within the agitator barrel 36 has been found to provide good clutch performance.

The present dog clutch is very tolerant to variations in dimensions, since the dogs 54 are only held loosely and pivot freely in the cam 58. Lost motion is reduced considerably over known agitator clutches. In one embodiment, the present clutch provides less than five degrees of lost motion between the skirt 32 and the barrel 36 upon reversing agitator strokes, and as such it is readily adaptable for use in short stroke, high stroke-rate agitators. In tests, the additional mechanical energy imparted to a wash load by the reduced lost motion of a dual-action agitator utilizing the present dog clutch provided five to ten percent better soil removal. The present clutch can be utilized in full size or in compact agitators, and is virtually immune to environmental conditions. For instance, the present clutch works well when it is wet or when it is exposed to lint or detergent.

As is apparent from the foregoing specification, the invention is susceptible of being embodied with various alterations and modifications which may differ particularly from those that have been described in the preceeding specification and description. It should be understood that we wish to embody within the scope of the patent granted hereon, all such modifications as reasonably and properly come within the scope of our contribution to the art.

The embodiments of the invention in which an exclusive property or priviledge is claimed are defined as follows:

1. A dog clutch for use in a washing machine agitator having a first agitator portion driven in oscillatory movement and a second agitator portion rotatably mounted on the first agitator portion with a radially inwardly projecting annular mounting ring, and having an interior annular friction surface, comprising:

a cam mounted adjacent the annular friction surface for movement with the first agitator portion, said cam having a plurality of spaced dog engaging portions each including a retaining rib and a stop spaced from said retaining rib; and a plurality of dogs resting on said mounting ring, each having a pivot member held within one of said dog engaging portions, said plurality of dogs being frictionally pivotally driven by said mounting ring into and out of engagement with the annular friction surface to drive the second agitator portion incrementally in a first direction at each oscillation of the first agitator portion.

2. A dual action agitator for use in a clothes washing machine having a wash tub and a means for rotationally oscillating a drive shaft extending into the tub, comprising:

a lower agitator fixedly mounted to the drive shaft in the wash tub for oscillating movement with the drive shaft;

an upper agitator mounted with a radially inwardly projecting annular mounting ring for rotating movement with respect to said lower agitator, said upper agitator including an inner friction surface;

a cam affixed to at least one of said lower agitator and said drive shaft;

a plurality of dogs frictionally engaging said mounting ring and pivotally mounted to said cam and pivotable upon rotation of said lower agitator due to said frictional engagement with said mounting ring to engage said friction surface and thereby drive said upper agitator in a first direction as said lower agitator oscillates.

3. An agitator as claimed in claim 2, wherein said lower agitator includes a plurality of radially projecting fins and said upper agitator includes a helically-formed auger fin extending from an exterior

4. An agitator as claimed in claim 2, wherein said friction surface is a toothed surface.

5. An agitator as claimed in claim 2, wherein each of said plurality of dogs include a pivot shaft portion adjacent a first end and a friction surface engaging face substantially adjacent a second opposite end.

6. An agitator as claimed in claim 5, wherein said friction surface engaging face includes a notch.

7. An agitator as claimed in claim 5, wherein said cam includes a plurality of curved retaining ribs and a like plurality of stops spaced from respective ones of said retaining ribs, said pivot shaft portions of said plurality of dogs being mounted between respective ones of said retaining ribs and stops.

8. An agitator as claimed in claim 7, wherein each of said plurality of retaining ribs includes a support fin projecting outwardly for supporting said dogs when said dogs are in a friction surface engaging position.

9. A washing machine for cleaning a wash load, comprising:

a wash tub mounted within said washing machine;

a drive shaft extending into said wash tub;

a motor and transmission connected to said drive shaft and operable to move said drive shaft in rotational oscillations;

a dual-action agitator connected to said drive shaft and including:

a lower agitator skirt having scrubbing means for imparting scrubbing action to a wash load, and an upper agitator barrel mounted on said lower agitator barrel with a mounting ring and having rollover means for moving portions of a wash load toward said scrubbing means;

a clutch connected to at least one of said drive shaft and said lower agitator skirt and including:

a cam mounted for rotational oscillations with said drive shaft, a plurality of dogs pivotally mounted in said cam and resting on said mounting ring, a contact surface within said agitator barrel, said plurality of dogs being pivotally moved into abutment with said contact surface through frictional engagement with said mounting ring to drive said upper agitator barrel during a first stroke of each rotational oscillation and being pivotally moved out of abutment with said contact surface during a second opposite stroke of each rotational oscillation.

10. A washing machine as claimed in claim 9, wherein said contact surface is toothed and each of said plurality of dogs has a tooth cooperating portion.

11. A washing machine as claimed in claim 9, wherein said scrubbing means includes a plurality of radially projecting fins and said rollover means includes an auger-type blade.

12. A washing machine as claimed in claim 9, wherein said dogs are of elastomeric material.

13. A washing machine as claimed in claim 12, wherein said elastomeric material is of 85 to 90 Durometer.

14. A washing machine as claimed in claim 9, wherein said cam is cup-shaped and fits over a portion of said lower agitator skirt.

15. A washing machine as claimed in claim 9, wherein each of said dogs has a hole formed therethrough.

16. A washing machine as claimed in claim 9, wherein four dogs are pivotally mounted to said cam.

17. A washing machine as claimed in claim 9, further comprising:

dog engaging portions spaced equally around said cam, each of said dog engaging portions including:
a curved retaining rib,
a support fin projecting from said retaining rib,
a stop spaced from said retaining rib;

said mounting ring extending inwardly within said upper agitator barrel adjacent said contact surface;

said dog engaging portions each loosely holding a portion of one of said dogs.

* * * * *